US008485202B1

(12) United States Patent
Lujan-Puckett et al.

(10) Patent No.: US 8,485,202 B1
(45) Date of Patent: Jul. 16, 2013

(54) HAIR HOLDER DEVICE

(76) Inventors: Felicia F. Lujan-Puckett, Tucson, AZ (US); Albert W. Puckett, Tucson, AZ (US)

( * ) Notice: Subject to any disclaimer, the term of this patent is extended or adjusted under 35 U.S.C. 154(b) by 2 days.

(21) Appl. No.: 13/114,914

(22) Filed: May 24, 2011

Related U.S. Application Data

(60) Provisional application No. 61/348,149, filed on May 25, 2010.

(51) Int. Cl.
*A45D 8/12* (2006.01)

(52) U.S. Cl.
USPC ..... 132/275

(58) Field of Classification Search
USPC ..... 132/273, 275–276; 24/72.5, 712.7, 24/136 L, 578.13, 612, 459, 472, 474; D28/39–43; 63/43
See application file for complete search history.

(56) References Cited

U.S. PATENT DOCUMENTS

| | | | | | |
|---|---|---|---|---|---|
| 491,199 | A * | 2/1893 | Swartz | 54/74 |
| 931,308 | A * | 8/1909 | Honsowetz | 24/472 |
| 3,530,550 | A * | 9/1970 | White | 24/464 |
| 4,308,647 | A * | 1/1982 | Gillis | 24/460 |
| 4,493,332 | A * | 1/1985 | Burger | 132/275 |
| 4,913,174 | A * | 4/1990 | Cusenza | 132/278 |
| 5,511,289 | A * | 4/1996 | Melia | 24/66.9 |
| 6,053,182 | A * | 4/2000 | Harmell | 132/275 |
| 6,131,585 | A * | 10/2000 | Reinstein et al. | 132/275 |
| 6,397,857 | B2 * | 6/2002 | Neary | 132/275 |
| 6,446,638 | B1 * | 9/2002 | Horman | 132/275 |

* cited by examiner

*Primary Examiner* — Rachel Steitz
*Assistant Examiner* — Jennifer Gill

(57) ABSTRACT

A hair holder device featuring an outer component having a slot disposed therein and an insertion component that can slideably insert snugly into the slot of the outer component. When the insertion component is within the slot, the slot surface and the outer surface of the insertion component can clamp and hold hair therein between, thereby creating a bun or puff effect for hair inserted therethrough. The bun or puff effect is shaped according to the shape of the insertion component.

7 Claims, 7 Drawing Sheets

FIG. 8

HAIR HOLDER DEVICE

CROSS REFERENCE

This application claims priority to U.S. provisional application Ser. No. 61/348,149 filed May 25, 2010, the specification of which is incorporated herein by reference in its entirety.

FIELD OF THE INVENTION

The present invention is directed to a device for holding hair. However, the present invention is not limited to use with hair and can, for example, be used on clothing.

BACKGROUND OF THE INVENTION

Hair holding devices such as barrettes, ponytail holders, and hair clips are popular devices used to hold hair and provide a user with an accessory with which he/she can add style to his/her wardrobe. The present invention features novel hair holding devices. Generally, the hair holding device comprises an outer component and an insertion component adapted to slide into and secure into a slot in the outer component, thereby sandwiching hair to create a unique look. The present invention is not limited to use as a hair holding device. For example, the present invention may alternatively be used on clothing as an accessory.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a novel hair holding device. In some embodiments, the hair holding device comprises an outer component having a slot disposed therein, wherein the slot has a slot surface; and an insertion component having an outer edge, wherein the outer edge can slidably insert into the slot of the outer component. When the insertion component is disposed within the slot, the slot surface and the outer surface of the insertion component can clamp and hold hair therein between, wherein a bun or puff effect is created for hair inserted therethrough in various shapes depending on a shape of the insertion component. The bun or puff effect is in an alternative shape if the hair is fed through the device in a ponytail fashion instead of a bun-like fashion.

In some embodiments, the outer component and the insertion component are connected. In some embodiments, a tether connects the outer component and the insertion component. In some embodiments, a first tether and a second tether connect the outer component and the insertion component, the first tether being positioned opposite the second tether. In some embodiments, the tether is stretchable. In some embodiments, the tether is constructed from a material comprising elastic.

In some embodiments, a hinge connects the outer component and the insertion component. In some embodiments, the hinge extends to form a barrette having a first arm and a second arm, the insertion component being fixed to the first arm. In some embodiments, the slot surface is at least partially lined with hooks or a gripping component. In some embodiments, the insertion component is fixed to a headband.

In some embodiments, the insertion component is fixed to a comb. In some embodiments, a decorative component is disposed on the outer component or on the insertion component. In some embodiments, the decorative component includes a flower, a bead, a sticker, a glitter, a bow, or a combination thereof.

In some embodiments, the outer component has a butterfly shape, a flower shape, an animal shape, a star shape, a heart shape, a moon shape, a sun shape, a peace sign shape, or a geometrical shape. In some embodiments, the insertion component has a butterfly shape, a flower shape, an animal shape, a star shape, a heart shape, a moon shape, a sun shape, a peace sign shape, or a geometrical shape. In some embodiments, the device further comprises a first hook-and-loop fastener disposed on the outer component. In some embodiments, the device further comprises a second hook-and-loop fastener disposed on the insertion component.

BRIEF DESCRIPTION OF THE DRAWINGS

FIG. 8 shows that the outer component (110) and insertion component (120) are connected together via a first pair of tethers (330*a*) and a second pair of tethers (330*a*) wherein the first pair of tethers (330*a*) is positioned opposite the second pair of tethers (330*b*). The first pair of tethers (330*a*) comprises a first tether (130*a*) and a third tether (130*c*). The second pair of tethers (330*b*) comprises a second tether (130*b*) and a fourth tether (130*d*). The first end (131*a*) of the first tether (130*a*) is attached to the bottom surface (112) of the outer component (110) adjacent to the inner rim (119*a*) of the outer component (110) and the second end (132*a*) of the first tether (130*a*) is attached to the outer edge (125) of the insertion component (120). The first end (131*c*) of the third tether (130*c*) is attached to the bottom surface (112) of the outer component (110) adjacent to the inner rim (119*a*) of the outer component (110) and the second end (132*c*) of the third tether (130*c*) is attached to the outer edge (125) of the insertion component (120). The first end (131*b*) of the second tether (130*b*) is attached to the bottom surface (112) of the outer component (110) adjacent to the inner rim (119*a*) of the outer component (110) and the second end (132*b*) of the second tether (130*b*) is attached to the outer edge (125) of the insertion component (120). The first end (131*d*) of the fourth tether (130*d*) is attached to the bottom surface (112) of the outer component (110) adjacent to the inner rim (119*a*) of the outer component (110) and the second end (132*d*) of the fourth tether (130*d*) is attached to the outer edge (125) of the insertion component (120).

DESCRIPTION OF PREFERRED EMBODIMENTS

Referring now to FIGS. 1-10, the present invention features novel hair holder devices 100. The present invention is not limited to use as a hair holding device. For example, the present invention may alternatively be used on clothing as an accessory.

Figure 1:
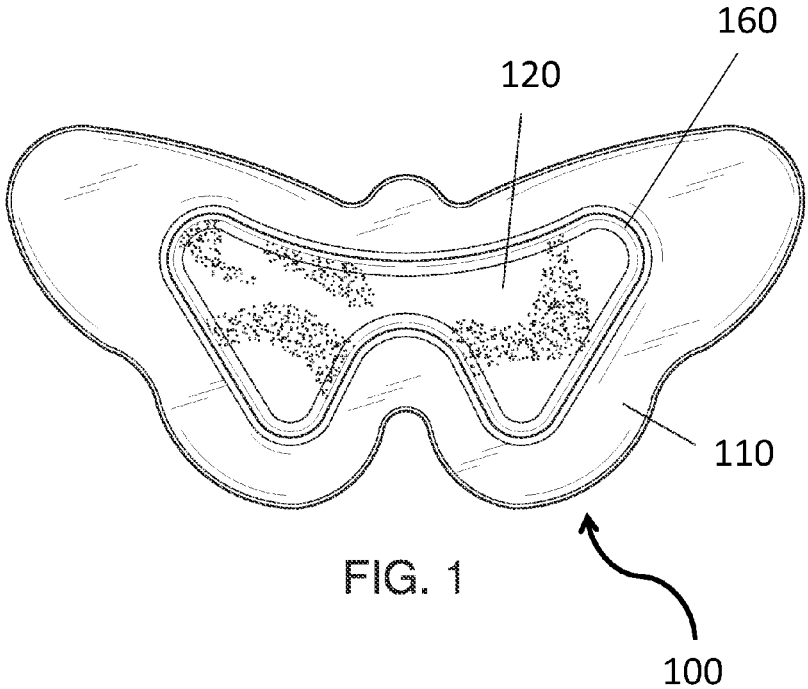
FIG. 1 is a top view of a hair holding device of the present invention.
Figure 2:
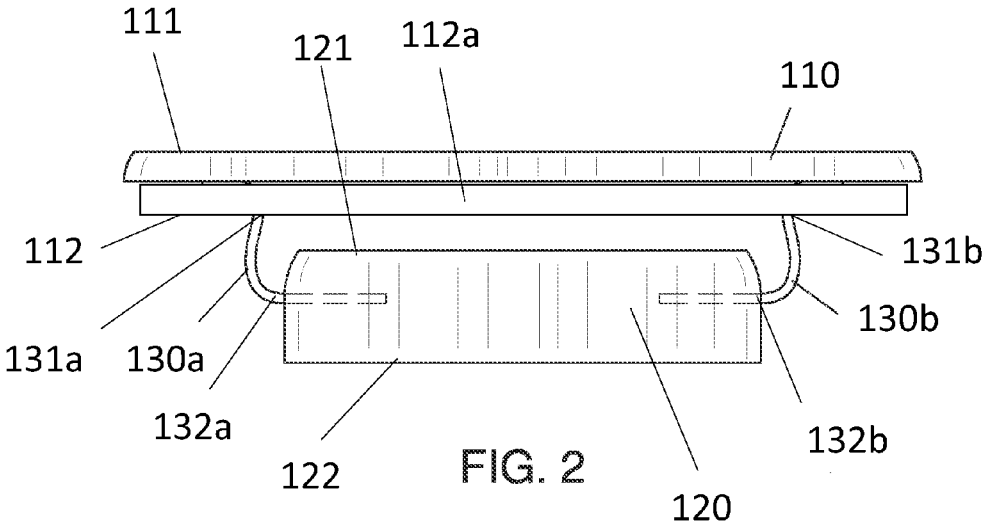
FIG. 2 is a side view of the hair holding device of FIG. 1.

The hair holder device 100 comprises an outer component 110 having a top surface 111 and a bottom surface 112. The outer component 110 may be constructed in a variety of shapes including but not limited to a butterfly shape (e.g., FIG. 1, FIG. 3), a flower shape (e.g. FIG. 5), an animal shape, a star shape, a heart shape, a moon shape, a sun shape, a peace sign shape, a geometrical shape (e.g., a circle, an oval shape, a diamond shape), the like, or a combination thereof. As shown in FIG. 2, the outer component 110 may be generally flat (e.g., the top surface 111 is generally flat), however the outer component 110 is not limited to being flat.

The outer component 110 may be constructed in a variety of sizes. For example, in some embodiments, the outer component 110 is between about 1/16 to 1/8 inches in thickness as measured from the top surface 111 to the bottom surface 112. In some embodiments, the outer component 110 is between about 1/8 to 1/4 inches in thickness as measured from the top surface 111 to the bottom surface 112. In some embodiments, the outer component 110 is between about 1/4 to 1 inch in thickness as measured from the top surface 111 to the bottom surface 112. In some embodiments, the outer component 110 is more than 1 inch in thickness.

Figure 8:
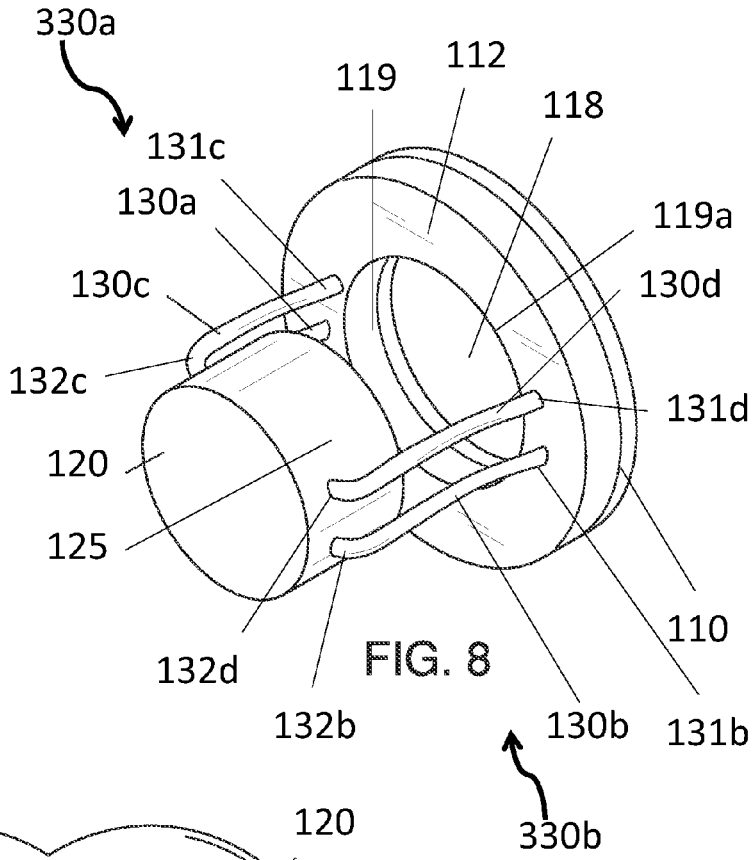
FIG. 8 is a perspective view of a hair holding device of the present invention.
Figure 7:
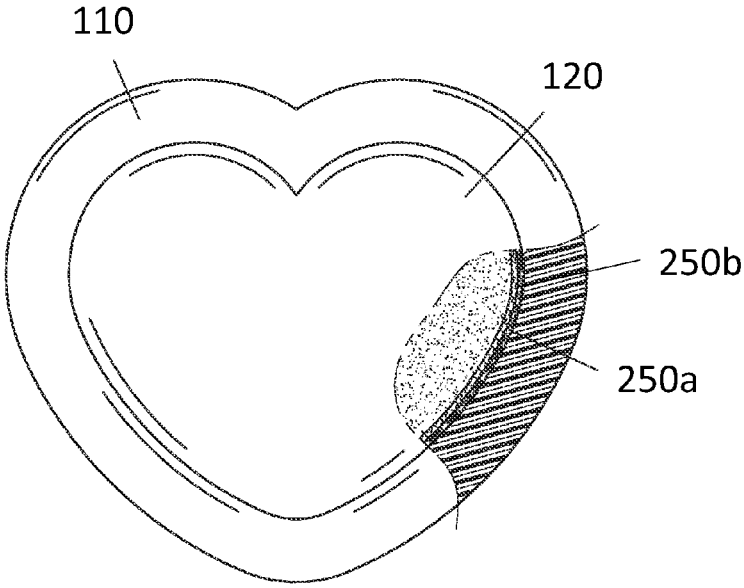
FIG. 7 is a top view of a hair holding device of the present invention.

The outer component 110 has a slot 118 disposed therein, for example in the center portion of the outer component 110. As shown in FIG. 8, the slot 118 has a slot surface 119 (e.g., an inner surface). In some embodiments, more than one slot 118 is disposed in the outer component 110 (e.g., see FIG. 9, wherein the device 100 has three slots 118). In some embodiments, two slots 118 are disposed in the outer component 110. In some embodiments, three slots 118 are disposed in the outer component 110. In some embodiments, four slots 118 are disposed in the outer component 110. In some embodiments, more than four slots 118 are disposed in the outer component 110.

Figure 10:
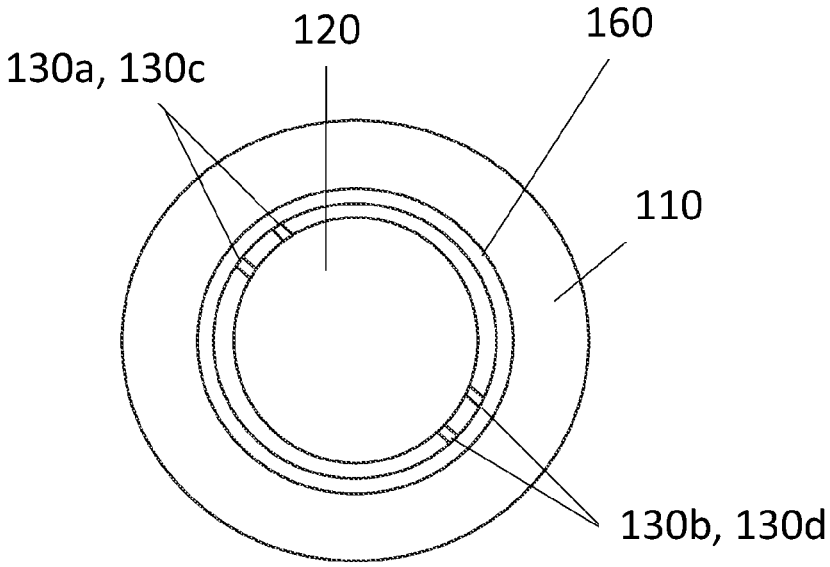
FIG. 10 is a top view of the hair holding device of FIG. 8.

The device 100 further comprises an insertion component 120 adapted to be inserted into the slot 118 in the outer component. The insertion component 120 has a top surface 121, a bottom surface 122, and an outer edge 125. The insertion component 120 may be constructed in a variety of shapes including but not limited to a butterfly shape (e.g., FIG. 1, FIG. 3), a flower shape (e.g., FIG. 5), an animal shape, a star shape, a heart shape, a moon shape, a sun shape, a peace sign shape, a geometrical shape (e.g., a circle as shown in FIG. 8 and FIG. 10, an oval shape, a diamond shape, a rectangle shape, etc.), the like, or a combination thereof. As shown in FIG. 2, the insertion component 120 may be generally flat (e.g., the top surface 121 is generally flat), however the insertion component 120 is not limited to being flat.

The outer component 110 and the insertion component 120 do not need to be the same shape. For example, in some embodiments, the outer component 110 is a circle and the insertion component 120 is a butterfly or a heart.

The insertion component 120 may be constructed in a variety of sizes. For example, in some embodiments, the insertion component 120 is between about 1/16 to 1/8 inches in thickness as measured from the top surface 121 to the bottom surface 122. In some embodiments, the insertion component 120 is between about 1/8 to 1/4 inches in thickness as measured from the top surface 121 to the bottom surface 122. In some embodiments, the insertion component 120 is between about 1/4 to 1 inch in thickness as measured from the top surface 121 to the bottom surface 122. In some embodiments, the insertion component 120 is more than 1 inch in thickness.

In some embodiments, the thickness of the outer component 110 is greater than the thickness of the inner component 110. In some embodiments, the thickness of the outer component 110 is less than the thickness of the inner component 110 (e.g., see FIG. 2). In some embodiments, the thickness of the outer component 110 is about the same as the thickness of the inner component 110.

The shape of the slot 118 and the shape of the insertion component 120 match. The outer edge 125 of the insertion component 120 slidably inserts into the slot 118 of the outer component 110 (e.g., in the slot surface 119). In some embodiments, the outer edge 125 of the insertion component 120 snugly inserts into the slot 118 of the outer component 110 (e.g., in the slot surface 119).

Figure 3:
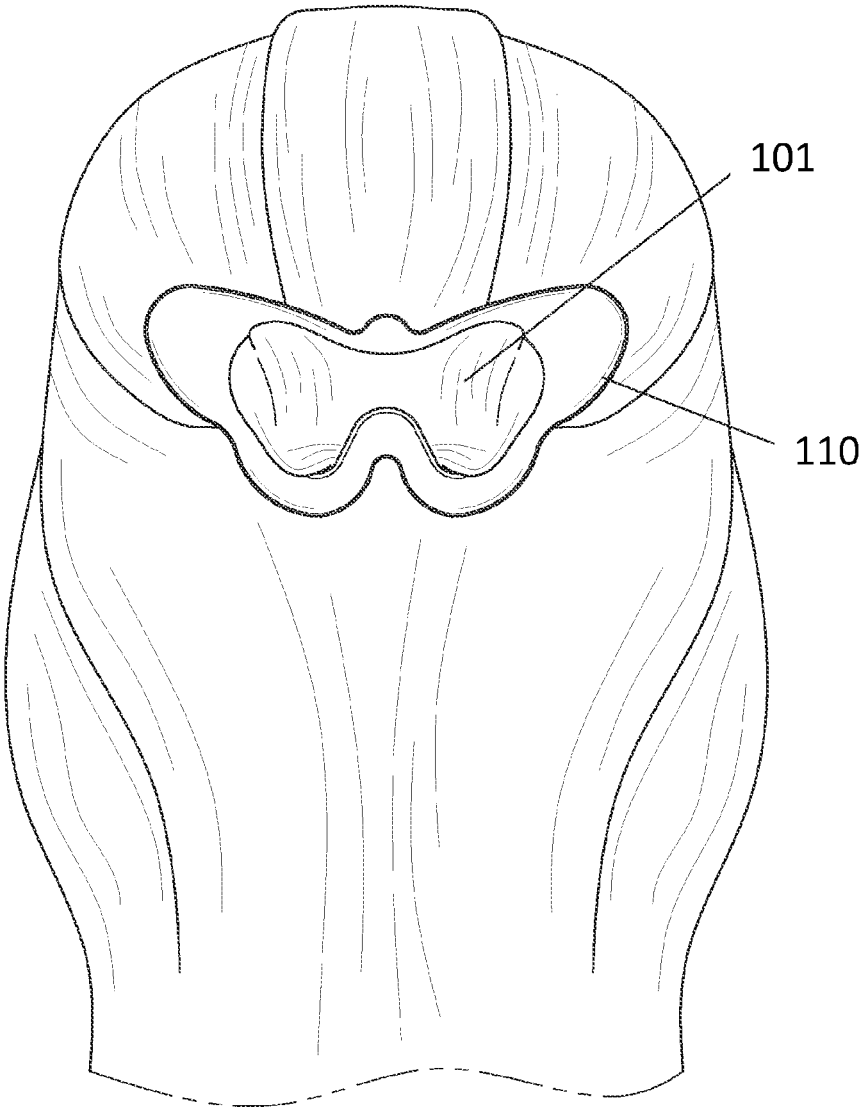
FIG. 3 is an in-use view of the hair holding device of FIG. 1.
Figure 4:
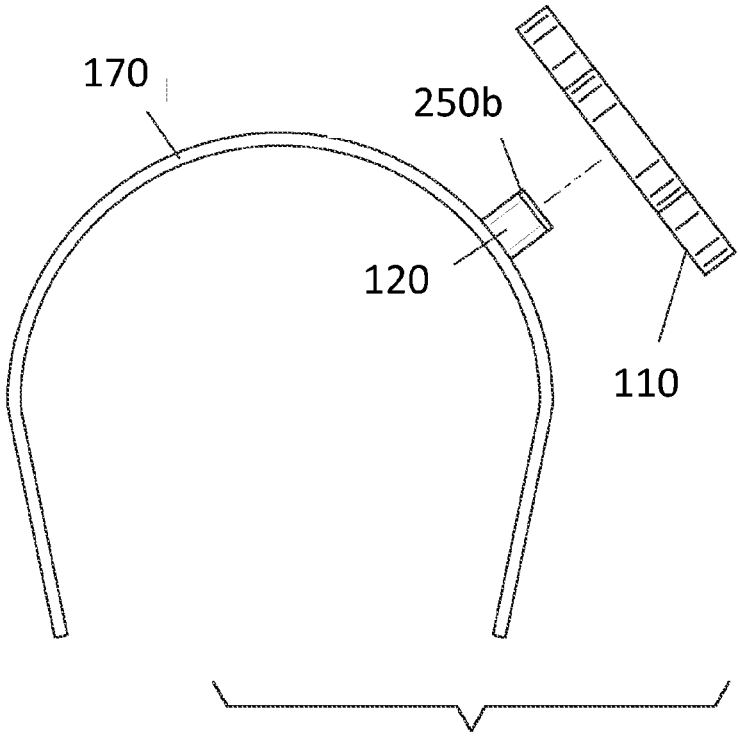
FIG. 4 is a side view of a hair holding device of the present invention.
Figure 5:
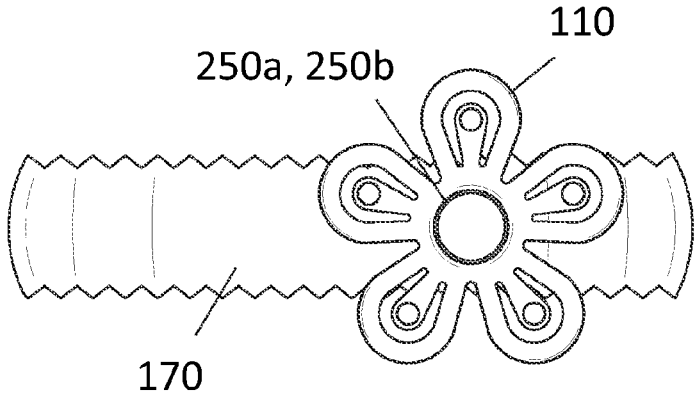
FIG. 5 is a top view of the hair holding device of FIG. 4.

When the insertion component 120 is disposed within the slot 118, the slot surface 119 and the outer surface 125 of the insertion component 120 can clamp and hold hair 101 therein between (e.g., hair 101 is sandwiched between the slot surface 119 and the outer surface 125 of the insertion component 120). This can create a bun or puff effect for hair 101 inserted therethrough. Hair may be fed through the slot 118 in a ponytail fashion instead of a traditional bun fashion. The bun or puff effect has a shape that depends on the shape of the insertion component 120. For example, as shown in FIG. 3, a butterfly-shaped insertion component 120 provides a butterfly-shaped puff effect. Any appropriate shape may be configured with the present invention.

Figure 9:
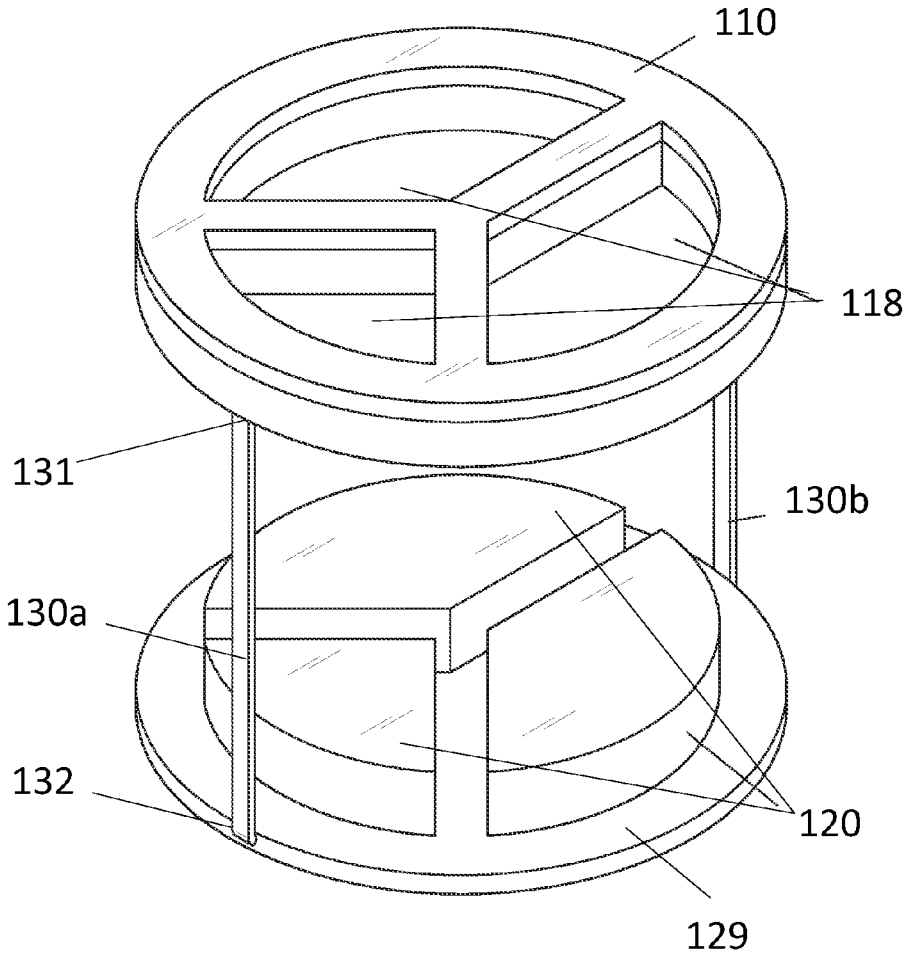
FIG. 9 is a perspective view of a hair holding device of the present invention.

As shown in FIG. 9, in some embodiments, the device 100 comprises more than one insertion component 120. For example, in some embodiments, the device 100 comprises two insertion components 120. In some embodiments, the device comprises three insertion components (e.g., see FIG. 9). In some embodiments, the device comprises more than three insertion components 120 (e.g., four insertion components 120, five insertion components 120, etc.). As shown in FIG. 9, the multiple insertion components 120 may be held together via an insertion component base 129. Generally, the number of insertion components 120 is the same as the number of slots 118, however the device 100 of the present invention is not limited to this configuration (e.g., the number of slots 118 may exceed the number of insertion components 120).

In some embodiments, the slot surface 119 is partially lined (e.g., at least partially lined) or fully lined with a gripping component (e.g., gripping foam). The gripping component (e.g., gripping foam 160) may provide additional gripping of the insertion component 120 and/or hair 101. For example, the gripping component may help provide a more snug fit between the insertion component 120 and the outer component 110. In some embodiments, the slot surface 119 is partially lined (e.g., at least partially lined) or fully lined with hooks, mesh, hook-and-loop fastener (e.g., a first hook-and-loop fastener 250*a*), rubber, the like, or a combination thereof. The gripping component or hooks (or mesh, hook-and-loop fasteners, rubber, etc.) may be effective to push against the insertion component 120 and stably hold the insertion component 120 within the slot 118 of the outer component 110. In some embodiments, the outer component 110 with a slot 118 that is at least partially lined with a gripping component, hooks, mesh, a hook-and-loop fastener, or rubber, for example, may be used alone as hair 101 may be secured by the gripping component, hooks, mesh, hook-and-loop fastener, or rubber when pulled through. The gripping component, hooks, mesh, hook-and-loop fastener, or rubber may be in any location on the outer component 110 e.g., on sides, on top, etc.

In some embodiments, the outer surface 125 of the insertion component 120 is partially lined (e.g., at least partially lined) or fully lined with a gripping component (e.g., gripping foam 160). The gripping component (e.g., foam) may provide additional gripping of the insertion component 120 and/or hair 101. For example, the gripping component may help provide a more snug fit between the insertion component 120 and the outer component 110. In some embodiments, the outer surface 125 of the insertion component 120 is partially lined (e.g., at least partially lined), or fully lined with hooks, mesh, hook-and-loop fastener (e.g., a second hook-and-loop fastener 250*b*), rubber, the like, or a combination thereof. The gripping component or hooks (or mesh, hook-and-loop fasteners, rubber, etc.) may be effective to push against the insertion component 120 and stably hold the insertion component 120 within the slot 118 of the outer component 110. In some embodiments, the outer component 110 with a slot 118 that is at least partially lined with a gripping component, hooks, mesh, a hook-and-loop fastener, or rubber, for example, may be used alone as hair 101 may be secured by the gripping component, hooks, mesh, hook-and-loop fastener, or rubber when pulled through. The gripping component, hooks, mesh, hook-and-loop fastener, or rubber may be in any location on the insertion component 120, e.g., on sides, on top, etc.

In some embodiments, the outer component 110 and the insertion component 120 are connected, e.g., via a tether 130. The tether 130 may have a first end 131 connected to the outer component 110 and a second end 132 connected to the insertion component 120. In some embodiments, the outer component 110 and the insertion component 120 are connected by a first tether 130*a* and a second tether 130*b*. The first tether 130*a* may be positioned opposite the second tether 130*b*. For example, the position where the first end 131*a* of the first tether 130*a* is attached to the outer component 110 and the position where the first end 131*b* of the second tether 130*b* is attached to the insertion component 120 are opposite each other (e.g., see FIG. 8). In some embodiments, the outer component 110 and the insertion component 120 are connected by more than two tethers 130, for example three tethers 130, four tethers 130 (e.g., two pairs of tethers as shown in FIG. 8), five tethers 130, or more than five tethers 130.

The tether 130 may attach to the bottom surface 112 of the outer component 110. In some embodiments, the tether 130 may attach to the top surface 111 of the outer component 110 or an outer edge of the outer component. The tether 130 may attach to the top surface 121 of the insertion component 120 or the outer edge 125 of the insertion component 120. In some embodiments, the tether 130 may attach to the bottom surface 122 of the insertion component 120.

The tether 130 may include but is not limited to a string, a rubber band, a piece of elastic, the like, or a combination thereof. The tether 130 may be stretchable. For example, in some embodiments, the tether 130 is constructed from a material comprising elastic. In some embodiments, the first end 131 and/or the second end 132 (or a portion of the first end and/or a portion of the second end 132) of the tether 130 are covered, for example with foam. In some embodiments, the tether 130 is removably attached to the outer component 110 and/or the insertion component 120. In some embodiments, the tether 130 is a hook-and-loop fastener system.

Figure 6:
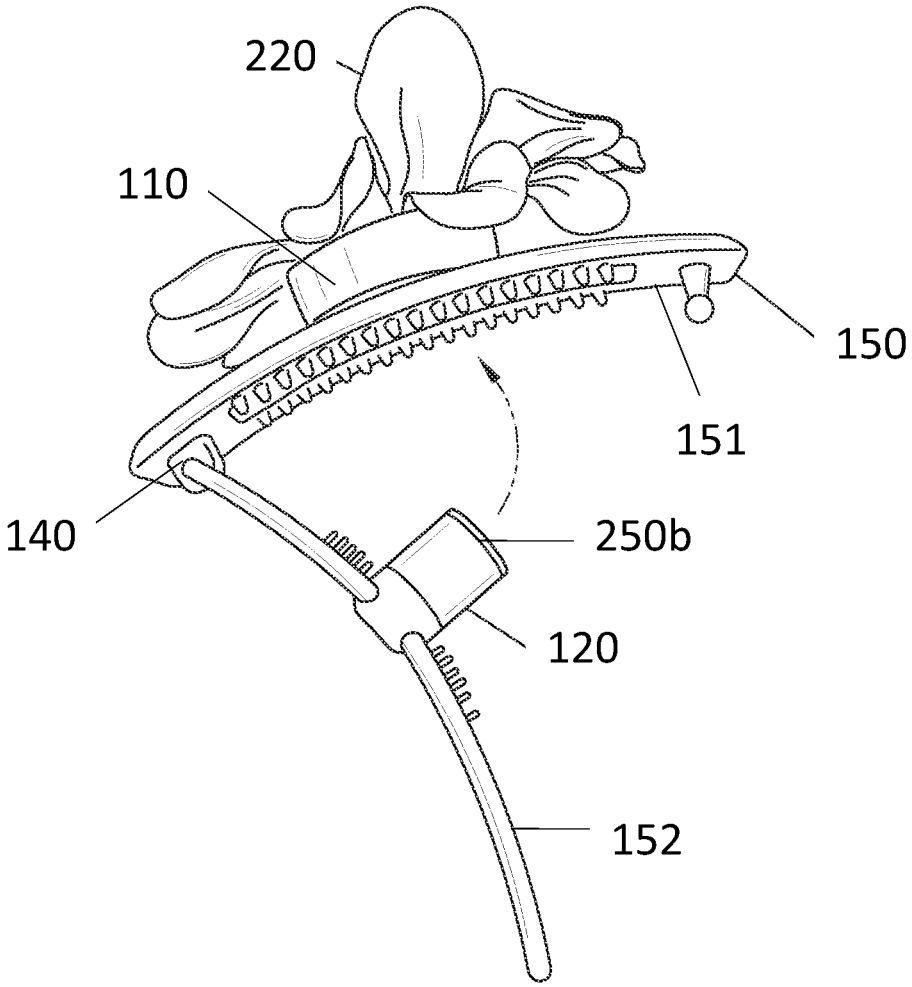
FIG. 6 is a perspective view of a hair holding device of the present invention.

As shown in FIG. 6, the outer component 110 and the insertion component 120 may be connected by a hinge 140. In some embodiments, the hinge 140 forms a barrette 150. For example, the hinge 140 forms a first arm 151 and a second arm 152 of a barrette 150. In some embodiments, the insertion component 120 (e.g., the bottom surface 122) is attached (e.g., fixed) to the first arm 151 of the barrette 150. The barrette 150 may be constructed in any appropriate shape, for example a butterfly, a heart, a flower, or other standard barrette shapes well known to one of ordinary skill in the art. To use the barrette 150 (with the present invention), a user can insert hair into the barrette 150, snap the barrette 150 down to clasp it shut, and a bun effect is created when the insertion component pushes some of the hair through the slot 118 in the outer component 110 when the barrette 150 is closed.

One or more devices 100 (e.g., insertion components 120, outer components 110) may be affixed to any device that can grab on to hair (hereinafter "hair-grab component"). Non-limiting examples of hair-grab components include a headband, a ponytail holder, a comb, a barrette and the like. For example, in some embodiments, the insertion component 120 is attached (e.g., fixed) to a headband 170 (e.g., see FIG. 4, FIG. 5). In some embodiments, the insertion component 120 is attached (e.g., fixed) to a comb. In some embodiments, the insertion component 120 is attached (e.g., fixed) to a ponytail holder. The insertion component 120 and/or outer component 110 may come in one or more pieces.

As shown in FIG. 6, in some embodiments, a decorative component 220 is disposed on the outer component 110 or on the insertion component 120. A decorative component 220 may include but is not limited to a flower, a bead, a sticker, a glitter, a bow, a feather, or a combination thereof.

The outer component 110 and/or the insertion component 120 may be constructed from any appropriate material. In some embodiments, the outer component 110 is constructed from a soft and/or rigid foam. In some embodiments, the outer component 110 is constructed from a plastic or metal. In some embodiments, the insertion component 120 is constructed from a soft and/or rigid foam. In some embodiment, the insertion component 120 is constructed from a plastic or metal.

In some embodiments, the outer component 110 and the insertion component 120 are connected together via a hook-and-loop fastener. In some embodiments, the outer component 110 and the insertion component 120 are connected together via a hook-and-loop fastener on one side and a permanent connector on the other side.

In some embodiments, the outer component 110 comprises a snap-on addition. The snap-on addition allows a user to choose a particular design for the outer component 110. The snap-on additions are interchangeable. For example a user can attach a first snap-on addition, then remove the first snap-on addition and replace it with a second snap-on addition. In some embodiments, a snap component is disposed on the outer component 110 (e.g., the top surface) that engages the snap on-additions.

In some embodiments, a bottom layer 112*a* is disposed on the bottom surface 112 of the outer component 110. The bottom layer 112*a* may be constructed from a material comprising foam, for example. In some embodiments, the first end 131*a* of the first tether 130*a* and the first end 131*b* of the second tether 130*b* engage the bottom layer 112*a* (e.g., see FIG. 2).

In some embodiments, the first tether 130*a* is fixedly attached to the outer component 110 and the insertion component 120. In some embodiments, the second end 132*b* of the second tether 130*b* is fixedly attached to the insertion component 120 and the first end 131*b* of the second tether 130*b* is removably attached to the outer component 110 (or bottom layer 112*a*) via an attachment means (e.g., a hook-and-loop fastener, a snap, a button, a clip, a magnet, the like, or a combination thereof). In some embodiments, the first end 131*b* of the second tether 130*b* is fixedly attached to the outer component 110 (or bottom layer 112*a*) and the second end 132*b* of the second tether 130*b* is removably attached to the insertion component via an attachment means (e.g., a hook-and-loop fastener, a snap, a button, a clip, a magnet, the like, or a combination thereof).

As used herein, the term "about" refers to plus or minus 10% of the referenced number. For example, an embodiment wherein the outer component 110 is about 1 inch in length includes an outer component that is between 0.9 and 1.1 inches in length.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hair holder device (100) comprising:

(a) an outer component (110) having a slot (118) disposed therein, the slot (118) has a slot surface (119); and (b) an insertion component (120) having an outer edge (125), the outer edge (125) can slidably insert into the slot (118) of the outer component (110);

wherein the outer component (110) and insertion component (120) are connected together via a first pair of tethers (330*a*) and a second pair of tethers (330*a*), the first pair of tethers (330*a*) comprises a first tether (130*a*) and a third tether (130*c*), the second pair of tethers (330*b*) comprises a second tether (130*b*) and a fourth tether (130*d*), the first pair of tethers (330*a*) is positioned opposite the second pair of tethers (330*b*);

wherein a first end (131*a*) of the first tether (130*a*) is attached to a bottom surface (112) of the outer component (110) adjacent to an inner rim (119*a*) of the outer component (110) and a second end (132*a*) of the first tether (130*a*) is attached to the outer edge (125) of the insertion component (120), and a first end (131*c*) of the third tether (130*c*) is attached to the bottom surface (112) of the outer component (110) adjacent to the inner rim (119*a*) of the outer component (110) and a second end (132*c*) of the third tether (130*c*) is attached to the outer edge (125) of the insertion component (120), wherein a first end (131*b*) of the second tether (130*b*) is attached to the bottom surface (112) of the outer component (110) adjacent to the inner rim (119*a*) of the outer component (110) and a second end (132*b*) of the second tether (130*b*) is attached to the outer edge (125) of the insertion component (120), and a first end (131*d*) of the fourth tether (130*d*) is attached to the bottom surface (112) of the outer component (110) adjacent to the inner rim (119*a*) of the outer component (110) and a second end (132*d*) of the fourth tether (130*d*) is attached to the outer edge (125) of the insertion component (120);

wherein when the insertion component (120) is disposed within the slot (118), the slot surface (119) and the outer surface of the insertion component (120) can clamp and hold hair therein between, wherein a bun or puff effect is created for hair inserted therethrough in various shapes depending on a shape of the insertion component (120).

2. The hair holder device (100) of claim 1, wherein the tethers (130) are stretchable.

3. The hair holder device of claim 1, wherein the tethers (130) are constructed from a material comprising elastic.

4. The hair holder device of claim 1, wherein the outer component (110) has a butterfly shape, a flower shape, an animal shape, a heart shape, or a peace sign shape.

5. The hair holder device of claim 1, wherein the insertion component (120) has a butterfly shape, a flower shape, an animal shape, a heart shape, or a peace sign shape.

6. The hair holder device of claim 1 further comprising a first hook-and-loop fastener (250*a*) disposed on the slot surface (119) of the outer component (110).

7. The hair holder device of claim 1 further comprising a second hook-and-loop fastener (250*b*) disposed on the outer edge (125) of the insertion component (120).

* * * * *